US011143487B1

(12) United States Patent
Reich et al.

(10) Patent No.: US 11,143,487 B1
(45) Date of Patent: Oct. 12, 2021

(54) MULTIPLE-POSITION FIREARM HOLSTER ADAPTER AND SYSTEM

(71) Applicants: John Alexander Reich, Sleepy Hollow, IL (US); Gary Norman Reich, Deerfield Township, OH (US)

(72) Inventors: John Alexander Reich, Sleepy Hollow, IL (US); Gary Norman Reich, Deerfield Township, OH (US)

( * ) Notice: Subject to any disclaimer, the term of this patent is extended or adjusted under 35 U.S.C. 154(b) by 0 days.

(21) Appl. No.: 17/201,079

(22) Filed: Mar. 15, 2021

Related U.S. Application Data

(60) Provisional application No. 62/994,054, filed on Mar. 24, 2020.

(51) Int. Cl.
*F41C 33/02* (2006.01)

(52) U.S. Cl.
CPC ..... *F41C 33/0263* (2013.01); *F41C 33/0227* (2013.01)

(58) Field of Classification Search
CPC .... F41C 33/045; F41C 33/041; F41C 33/043; F41C 33/02; F41C 33/0272; A45F 2200/0591; A45F 2005/025; A45F 2005/027
See application file for complete search history.

(56) References Cited

U.S. PATENT DOCUMENTS 5,372,288 A * 12/1994 Rogers ..... A45F 5/00 224/198
5,467,909 A * 11/1995 Resca ..... F41C 33/045 224/244
5,551,611 A * 9/1996 Gilmore ..... A45F 5/00 224/192
6,010,045 A 1/2000 Rogers et al.
6,161,741 A 12/2000 French
6,575,343 B2 6/2003 Mossman
6,685,067 B2 2/2004 French
7,320,420 B2 1/2008 Buis et al.
7,331,872 B1 * 2/2008 Parsons ..... A45F 5/02 224/195
7,657,977 B2 2/2010 Clifton, Jr.
7,690,541 B2 4/2010 Pellegrini
7,866,515 B1 1/2011 Buis, III et al.
7,971,762 B2 7/2011 Clifton, Jr.
(Continued)

OTHER PUBLICATIONS

Strike Industries, Ricci Holster Adapter, https://www.strikeindustries.com/ricci-holster-adapter.html.

(Continued)

*Primary Examiner* — Corey N Skurdal
(74) *Attorney, Agent, or Firm* — Dorton & Willis, LLP

(57) ABSTRACT

An exemplary holster system may include an attachment component configured to be secured on a user; a firearm holster configured to hold a firearm; and a holster adapter operatively coupling the firearm holster and the attachment component. The holster adapter may be configured for one-handed repositioning of the firearm holster relative to the attachment component along an arcuate path between a first position and a second position while the holster system is worn by the user. The first position may include a first location and a first orientation, and the second position may include a second location, different from the first location, and a second orientation, different from the first orientation.

20 Claims, 10 Drawing Sheets

(56) References Cited

U.S. PATENT DOCUMENTS

| | | | |
|---|---|---|---|
| 8,215,525 | B2 | 7/2012 | Rassias |
| D710,595 | S | 8/2014 | Clifton, Jr. |
| 9,109,857 | B2 | 8/2015 | Kendrick |
| 9,228,802 | B2 | 1/2016 | Ribas |
| 9,696,113 | B2 | 7/2017 | Tedder et al. |
| 9,835,410 | B2 | 12/2017 | Morgan et al. |
| 10,295,305 | B2 | 5/2019 | Tedder et al. |
| 10,782,094 | B2 | 9/2020 | Rogers et al. |
| 10,883,795 | B2 | 1/2021 | Rogers et al. |
| 2010/0243690 | A1 | 9/2010 | Lerch |
| 2015/0097011 | A1 | 4/2015 | Clifton, Jr. |
| 2018/0010885 | A1 | 1/2018 | Tedder et al. |
| 2018/0120057 | A1* | 5/2018 | Robertson ..... F41C 33/041 |
| 2020/0116455 | A1 | 4/2020 | Haggart et al. |
| 2020/0309484 | A1 | 10/2020 | Zhang |
| 2020/0393214 | A1 | 12/2020 | De Oliveira Ribas |

OTHER PUBLICATIONS

Safariland, LLC, VUBL Vertical Belt Loop, https://safariland.com/products/vubl-vertical-belt-loop-vubl.

* cited by examiner

MULTIPLE-POSITION FIREARM HOLSTER ADAPTER AND SYSTEM

CROSS-REFERENCE TO RELATED APPLICATIONS

This application claims the benefit of priority to U.S. Provisional Patent Application Ser. No. 62/994,054, filed Mar. 24, 2020, the disclosure of which is incorporated by reference herein in its entirety.

TECHNICAL FIELD

The present disclosure relates generally to holsters for firearms, such as handguns, and, more particularly, to holster systems that are repositionable with respect to the user, such as while the holster system is being worn by the user, as well as components of repositionable holster systems and methods related to repositionable holster systems.

BACKGROUND

The present disclosure contemplates that law enforcement personnel, military personnel, and other users may carry a variety of firearms, including handguns such as pistols and revolvers. A handgun may be carried in a holster, which may be constructed from materials such as molded plastic, leather, and/or imitation leather. A firearm holster may be secured to the user's body, such as by being worn on a duty belt.

The present disclosure contemplates that it may be desirable for a firearm holster to be repositionable, such as by allowing adjustment of the holster's orientation (e.g., cant angle) and/or location (e.g., drop height). For example, a user may adjust the cant angle and/or drop height of a holster to hold the firearm at a desired position with respect to the user's body. Some firearm holsters are adjustable, but adjustment may require removal of the holster from the user's body and at least partial disassembly of the holster.

The present disclosure contemplates that, in some circumstances, it may be desirable for a user to reposition a firearm holster while the holster is being worn. For example, it may be desirable for a user to reposition a firearm holster when the user moves from a standing position to a sitting position and/or when the user moves from a sitting position to a standing position. FIG. 6 is a side elevation view of a prior art holster system 500 with the user in a sitting position. The present disclosure contemplates that the prior art holster system 500 may not be readily repositionable by a user while the holster system 500 is being worn and/or may be configured for use primarily by a standing user. When the user is in a sitting position, the firearm may be positioned such that the muzzle end of the firearm (or the corresponding end of the holster) contacts the seat. Similarly, the grip of the firearm may be positioned near or in contact with the seat back. As a result, the holster system 500 may be uncomfortable when the user is in a sitting position, and the holster system 500 may interfere with use of a seatbelt. Further, it may be difficult for the user to draw the firearm when seated due to the awkward positioning of the firearm.

Although some holsters may be repositionable while being worn, the present disclosure contemplates that there is a need for additional improvements related to repositionable holsters for firearms, particularly with respect to repositionable holsters configured to facilitate one-handed operation and/or operation under stress (e.g., employing muscle-memory and gross motor skills).

SUMMARY

It is an aspect of the present disclosure to provide a holster system including an attachment component configured to be secured on a user, a firearm holster configured to hold a firearm, and/or a holster adapter operatively coupling the firearm holster and the attachment component. The holster adapter may be configured for one-handed repositioning of the firearm holster relative to the attachment component along an arcuate path between a first position and a second position while the holster system is worn by the user. The first position may include a first location and a first orientation, and the second position may include a second location, different from the first location, and a second orientation, different from the first orientation.

The first position may be associated with a standing position of the user and/or the second position may be associated with a sitting position of the user. The holster adapter may be configured so that the firearm holster is disposed relative to an upper body of the user in substantially the same orientation in both of the first position and the second position.

The holster adapter may be configured so that movement of the firearm holster relative to the attachment component along the arcuate path simultaneously changes both a relative orientation and a relative location of the firearm holster with respect to the attachment component.

The holster adapter may be repositionable from the second position to the first position by a one-handed, gross-motor-skill movement of the firearm holster along the arcuate path. The holster adapter may include a selectively actuated locking mechanism configured to selectively secure the holster adapter in the first position.

The holster adapter may be repositionable from the first position to the second position by one-handed disengagement of the locking mechanism and movement the firearm holster along the arcuate path. The holster adapter may include a retaining element configured to releasably retain the holster adapter in the second position. The retaining element may be releasable by application of force on the firearm holster in a direction generally from the second position toward the first position.

In another aspect, a holster adapter may be configured to operatively couple a firearm holster and an attachment component, the firearm holster being configured to hold a firearm and the attachment component being configured to be secured on a user's body. The holster adapter may include an attachment component element configured to be secured relative to the user via the attachment component, a holster element configured to be secured to the firearm holster, and/or a locking mechanism configured to selectively secure the holster element with respect to the attachment component element in a first position. The first position may include a first location and/or a first orientation. One of the attachment component element or the holster element may include a traveler and the other of the attachment component element or the holster element may include a track. The track may define an arcuate path along which the traveler may be selectively movable between the first position and a second position. The second position may include a second location, different from the first location, and a second orientation, different from the first orientation.

The traveler and the track may be configured so that movement of the traveler relative to the track along the arcuate path simultaneously changes both a relative orientation and a relative location of the holster element with respect to the attachment component element. The track may include an elongated channel configured to slidably receive the traveler at least partially therein. The attachment component element may include the traveler and the holster element may include the track.

The locking mechanism may include a spring-biased latch bolt configured to selectively engage the traveler to secure the traveler with respect to the track when the traveler is in the first position. The locking mechanism may include an actuator operable to retract the latch bolt from the traveler. The holster adapter may include a housing at least partially containing the traveler. The actuator may include a depressible button disposed on a generally forward-facing portion of the housing relative to the user's body when a holster system comprising the holster adapter is worn by the user. The locking mechanism may be configured to automatically engage the traveler when the traveler is moved into the first position.

The holster adapter may include a retaining element configured to selectively retain the traveler in the second position. The retaining element may include a spring-biased tab extending from the track to releasably engage the traveler when the traveler is in the second position. The retaining element may be releasable by application of force on the traveler in a direction generally from the second position toward the first position.

A holster system may include the holster adapter and the attachment component. At least a portion of the attachment component element may be integrally formed with at least a portion of the attachment component. The holster system may include the firearm holster. At least a portion of the holster element may be integrally formed with at least a portion of the firearm holster.

In another aspect, a method of assembling a holster system may include assembling a holster adapter by operatively connecting (i) an attachment component element configured to be secured to an attachment component, (ii) a holster element configured to be secured to a firearm holster, and (iii) a locking mechanism. The holster element may be repositionably coupled to the attachment component element for movement along an arcuate path relative to the attachment component between a first position and a second position. The locking mechanism may be configured to selectively secure the holster element with respect to the attachment component element in the first position. The first position may include a first location and a first orientation, and the second position may include a second location, different from the first location, and a second orientation, different from the first orientation. Movement along the arcuate path may simultaneously change both a relative orientation and a relative location of the holster element relative to the attachment component element.

The method may include (i) integrally forming the attachment component element and at least a portion of the attachment component, and/or (ii) coupling the attachment component element and the attachment component. The method may include attaching the attachment component to a duty belt. The method may include securing the holster element to the firearm holster.

Assembling the holster adapter may include operatively connecting a traveler and a track. The holster element may include the traveler and/or the attachment component element may include the track. The track may define the arcuate path. The traveler may be selectively movable along the arcuate path between the first position and the second position. Assembling the holster adapter may include installing a latch bolt arranged to selectively secure the holster element relative to the attachment component element when the holster element is in the first position. The method may include installing a retaining element configured to selectively retain the holster element in the second position.

The above and other objects and advantages of the present disclosure shall be made apparent from the accompanying drawings and the description thereof.

DETAILED DESCRIPTION

Exemplary embodiments according to the present disclosure are described and illustrated below to encompass devices, methods, and techniques relating to holsters for firearms. Of course, it will be apparent to those of ordinary skill in the art that the embodiments discussed below are examples and may be reconfigured without departing from the scope and spirit of the present disclosure. It is also to be understood that variations of the exemplary embodiments contemplated by one of ordinary skill in the art shall concurrently comprise part of the instant disclosure. However, for clarity and precision, the exemplary embodiments as discussed below may include optional steps, methods, and features that one of ordinary skill should recognize as not being a requisite to fall within the scope of the present disclosure.

The present disclosure includes, among other things, holsters for firearms, such as handguns, and, more particularly, to holster systems that are repositionable with respect to the user, such as while the holster system is being worn by the user, as well as components of repositionable holster systems and methods related to repositionable holster systems. Some exemplary embodiments according to at least some aspects of the present disclosure may allow a user to readily reposition a firearm holster between a plurality of positions, such as a position suitable for standing and a position suitable for sitting.

Figure 1:
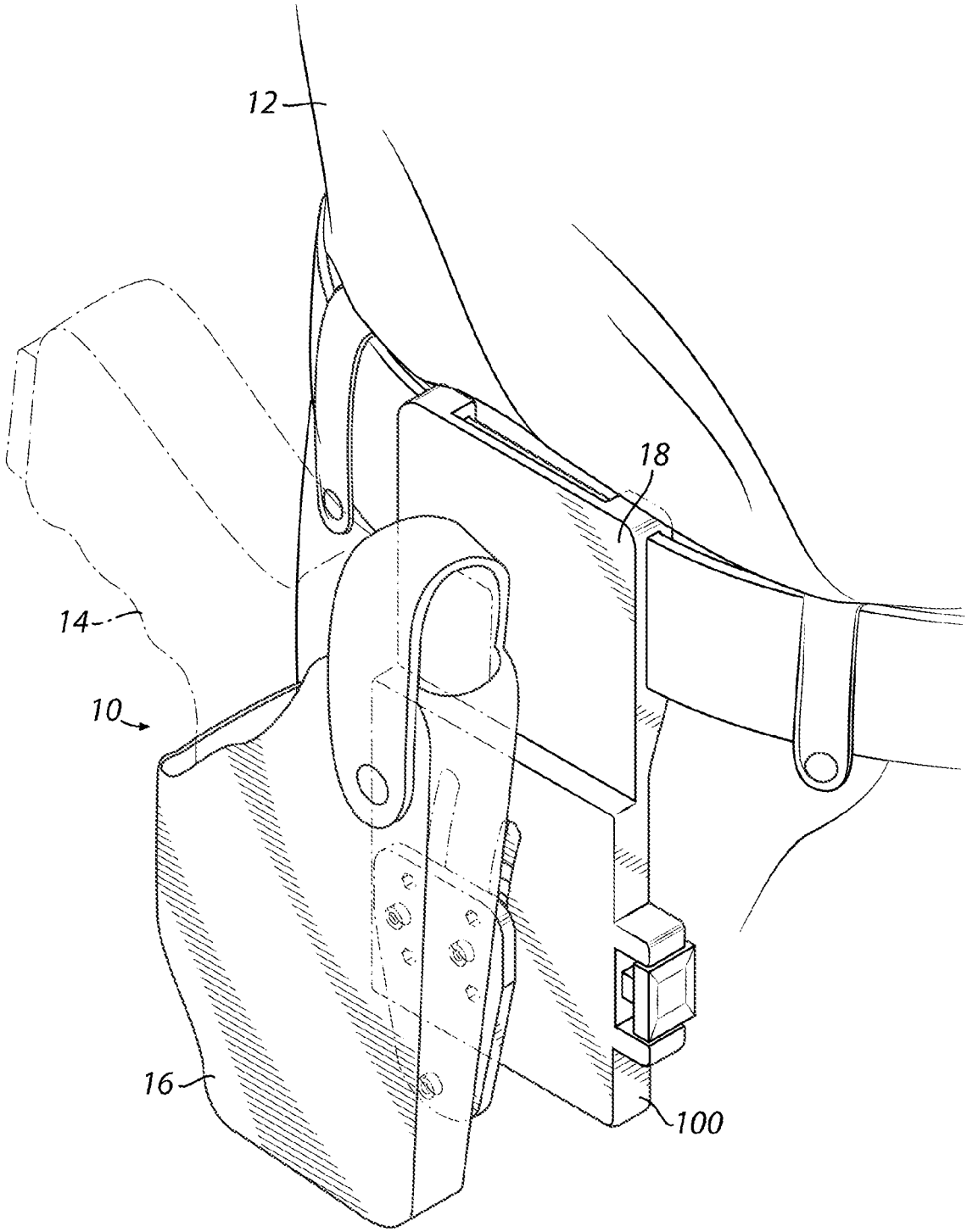
FIG. 1 is a perspective view of an exemplary holster system in accordance with the principles of the present disclosure.

FIG. 1 is a perspective view of an exemplary holster system 10, according to at least some aspects of the present disclosure. Generally, the holster system 10 may be configured to facilitate a user 12 carrying a firearm 14, typically a handgun (e.g., a pistol or revolver). The holster system 10 may include a firearm holster 16, which may be configured to hold the firearm 14. The holster system 10 may include an attachment component 18, which may be configured to be secured on the user 12. For example, the attachment component 18 may comprise one or more belt loops configured to secure the holster system to a belt, such as a duty belt, and/or elements configured to engage a thigh strap. The holster system 10 may include a holster adapter 100, which may operatively couple the firearm holster 16 and the attachment component 18. The holster adapter 100 may be configured to allow the user to reposition the firearm holster 16 relative to the attachment component 18.

Figure 2A:
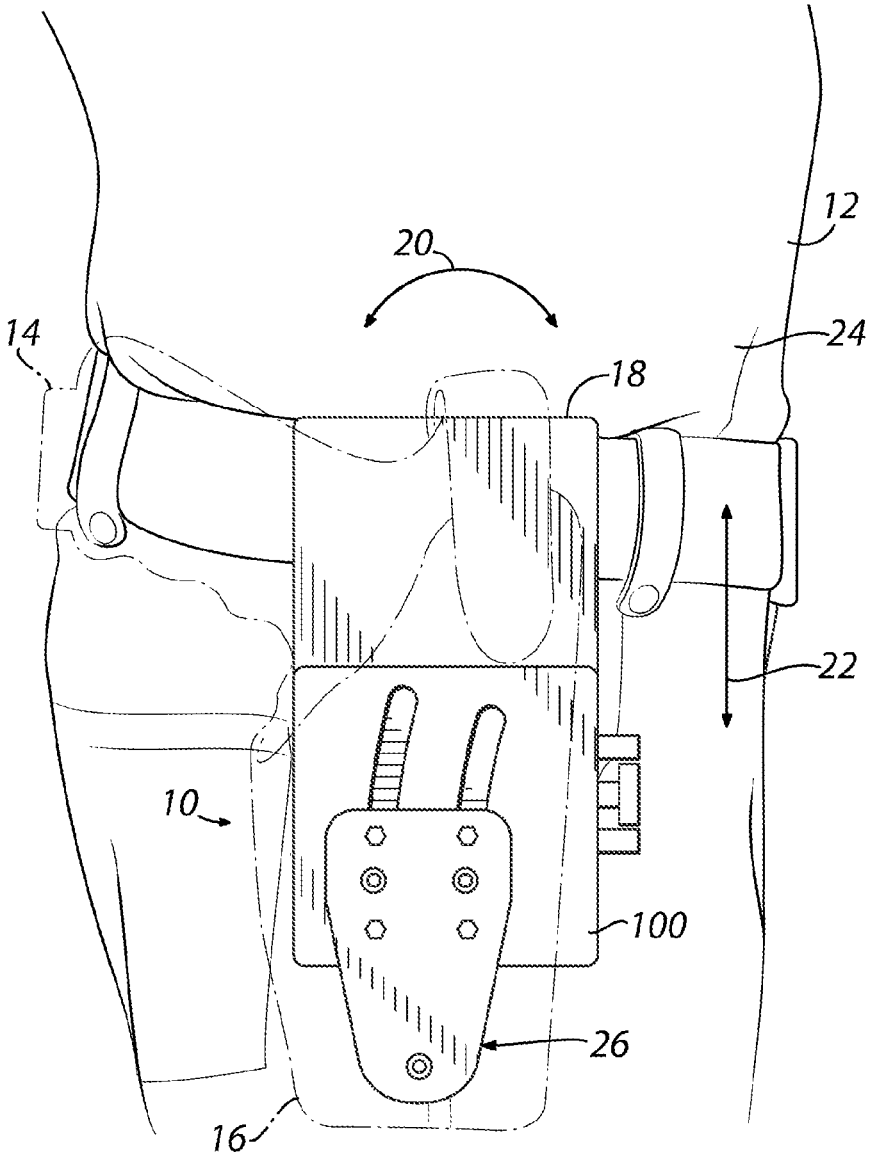
FIG. 2A is a side elevation view of the exemplary holster system of FIG. 1 in a first position.
Figure 2B:
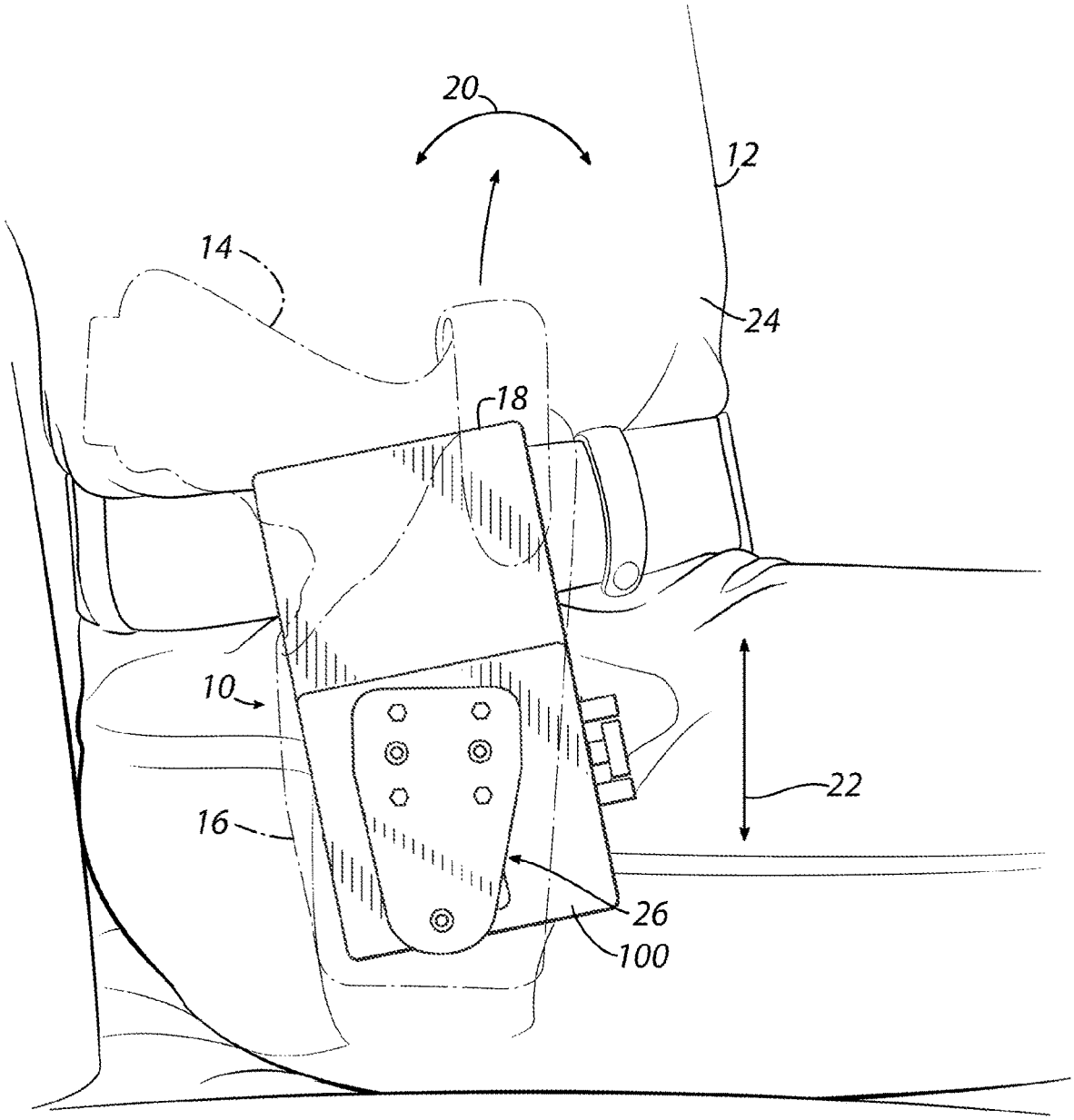
FIG. 2B is a side elevation view of the exemplary holster system of FIG. 1 in a second position.

FIG. 2A is a side elevation view of the exemplary holster system 10 in a first (e.g., standing) position and FIG. 2B is a side elevation view of the exemplary holster system 10 in a second (e.g., sitting) position, all according to at least some aspects of the present disclosure. In this exemplary embodiment, the holster adapter 100 may be configured to allow the user to reposition the holster system 10 between the first position (FIG. 2A) and the second position (FIG. 2B). As used herein, "position" may refer to an orientation (e.g., an angle of rotation) and a location (e.g., site or point in space).

Referring to FIG. 2A, in the first position, the firearm holster 16 may be disposed at a first orientation (e.g., cant angle) 20 and/or a first location (e.g., ride height) 22, such as relative to the attachment component 18. Referring to FIG. 2B, in the second position, the firearm holster 16 may be disposed at a second orientation 20 and/or a second location 22, such as relative to the attachment component 18. Referring to FIGS. 2A and 2B, in some exemplary embodiments, the first orientation 20 relative to the attachment component 18 may be different than the second orientation 20 relative to the attachment component 18 and/or the first location 22 relative to the attachment component 18 may be different than the second location 22 relative to the attachment component 18. In some exemplary embodiments, the firearm holster 16 may move from a relatively downward and rearward location and/or relatively rearward tilt for a standing user 12 (FIG. 2A) to a relatively forward and upward location and/or forward tilt for a sitting user 12 (FIG. 2B). For example, the upward-downward repositioning may prevent the firearm holster 16 from conflicting with the seat bottom, the forward-rearward repositioning may prevent the firearm holster 16 from conflicting with the seat back, and/or the forward/rearward tilting may orient the firearm holster 16 to facilitate drawing the firearm 14.

The present disclosure contemplates that in some high-stress situations, such as situations requiring the use of a firearm, the human body may instinctively rely upon "muscle-memory" and "gross motor skills." In these high-stress situations, the human body may be unable to perform actions requiring "fine motor skills." Accordingly, the present disclosure contemplates that some training for firearm users may be designed to condition the user's reflexes to draw a firearm quickly and efficiently while relying on muscle-memory and gross motor skills. This training may be compromised if a firearm holster is positioned substantially differently when the user draws the firearm (e.g., in a high-stress situation) than during the training.

Figure 6:
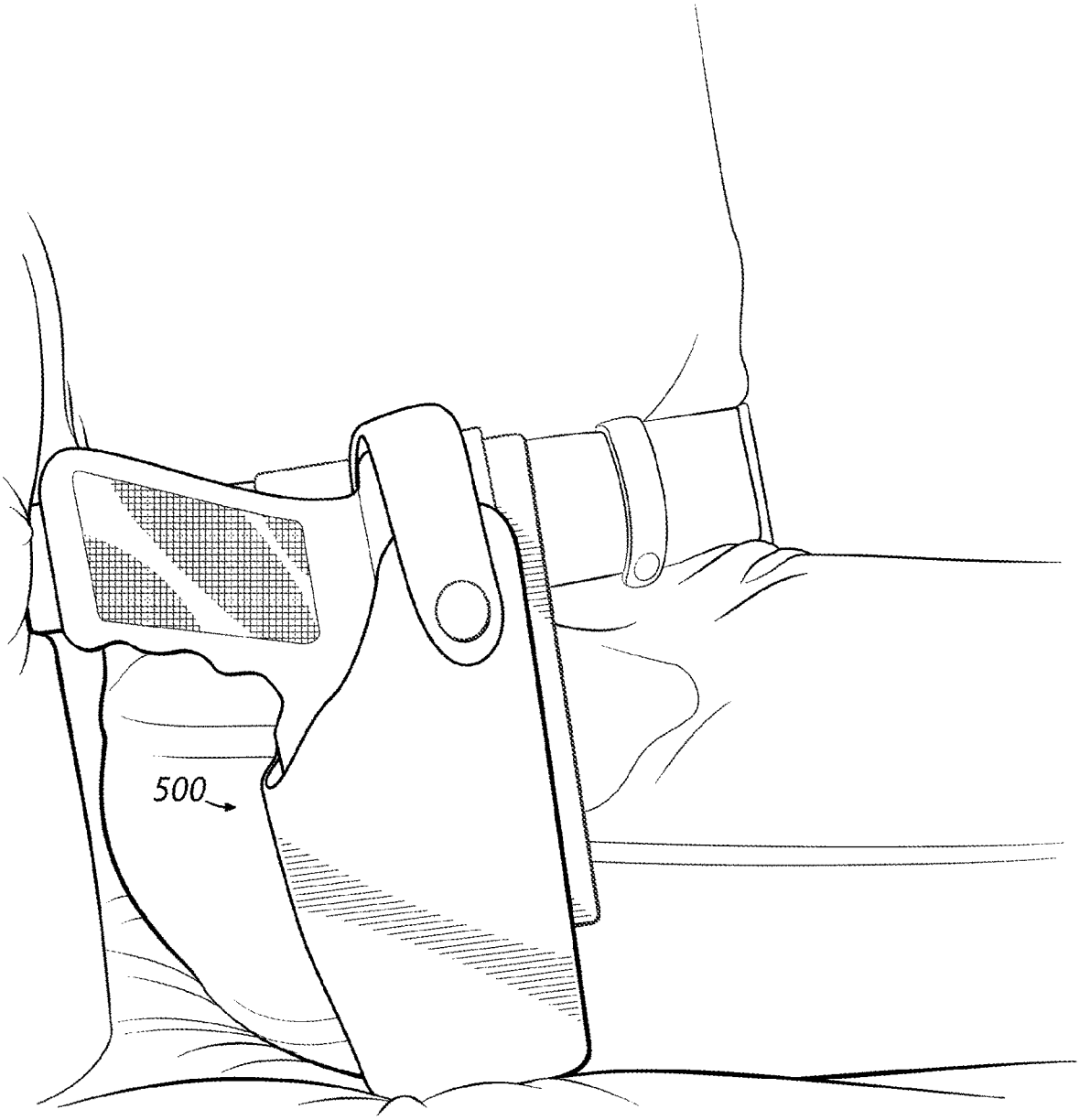
FIG. 6 PRIOR ART
FIG. 6 is a side elevation view of a prior art holster system with the user in a sitting position.

Referring to FIGS. 2A and 2B, some exemplary holster systems 10 may be configured so that the firearm holster 16 is disposed in generally the same orientation and/or location relative to the user's upper body 24 (e.g., chest and/or shoulders) in both the first position and the second position. For example, the change in orientation of the firearm holster 16 relative to the attachment component 18 may generally correspond to the change in orientation of the attachment component 18 relative to the user's upper body 24 between the first and second positions. As a result, some exemplary embodiments may allow the user to draw the firearm 14 and/or holster the firearm 14 in generally the same manner both while standing and while seated. In contrast, the position of the prior art firearm holster shown in FIG. 6 is substantially different than it would be when the user is standing, potentially compromising the user's ability to draw the firearm relying on gross motor skills and muscle memory.

Figure 3A:
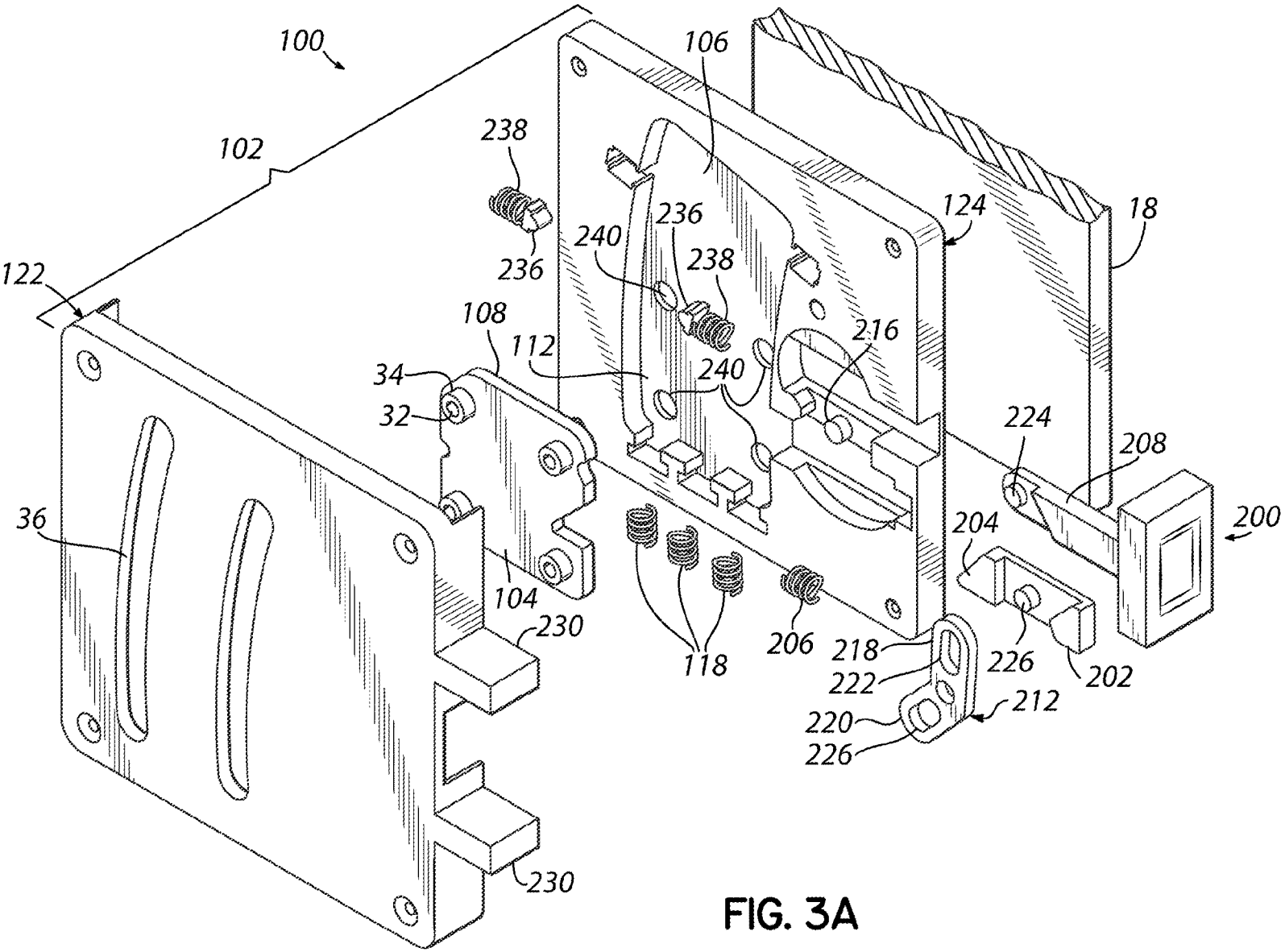
FIG. 3A is an exploded perspective view of the exemplary holster adapter of FIG. 1.
Figure 3B:
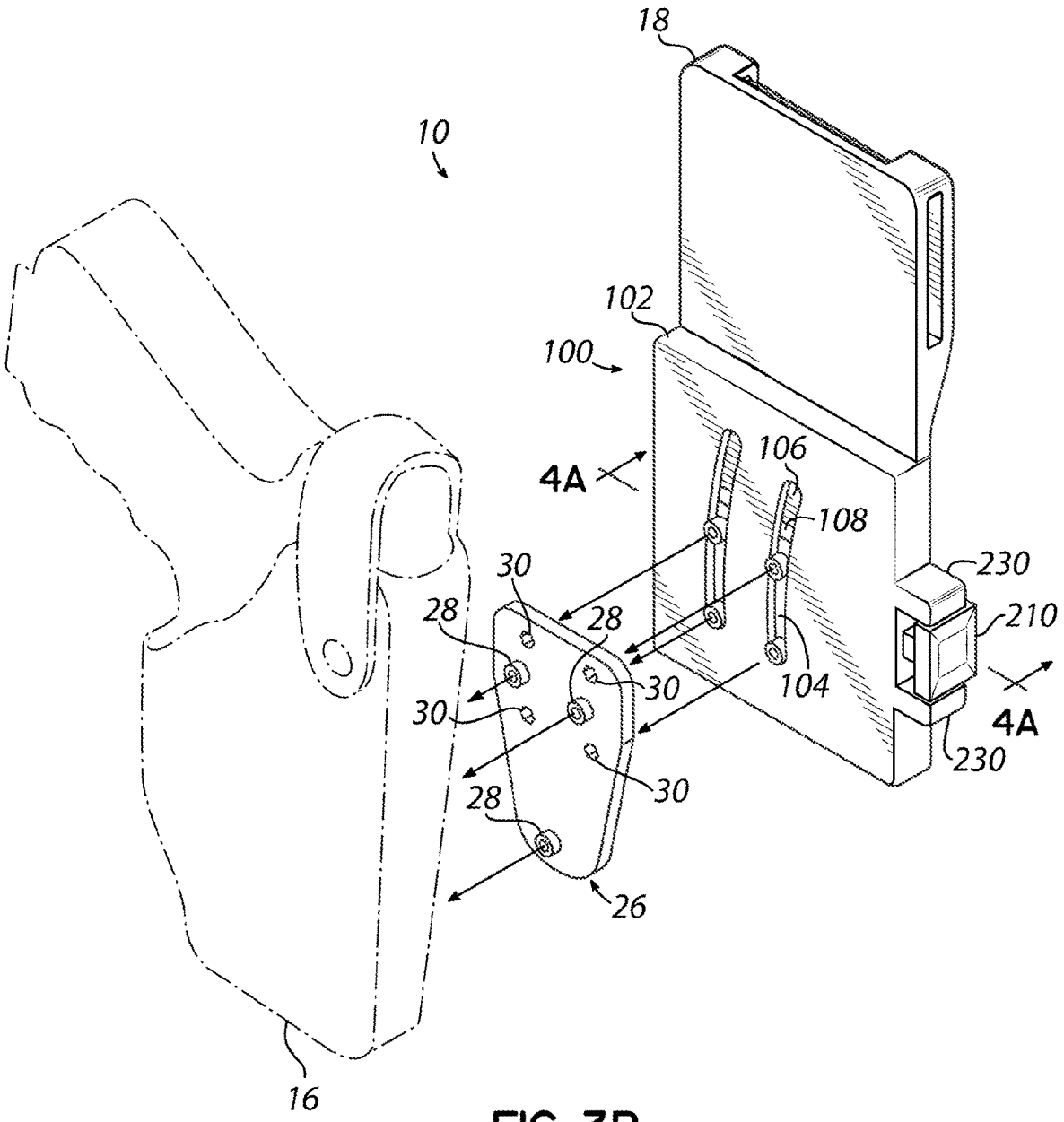
FIG. 3B is an exploded perspective view of the exemplary holster system of FIG. 1.
Figure 4A:
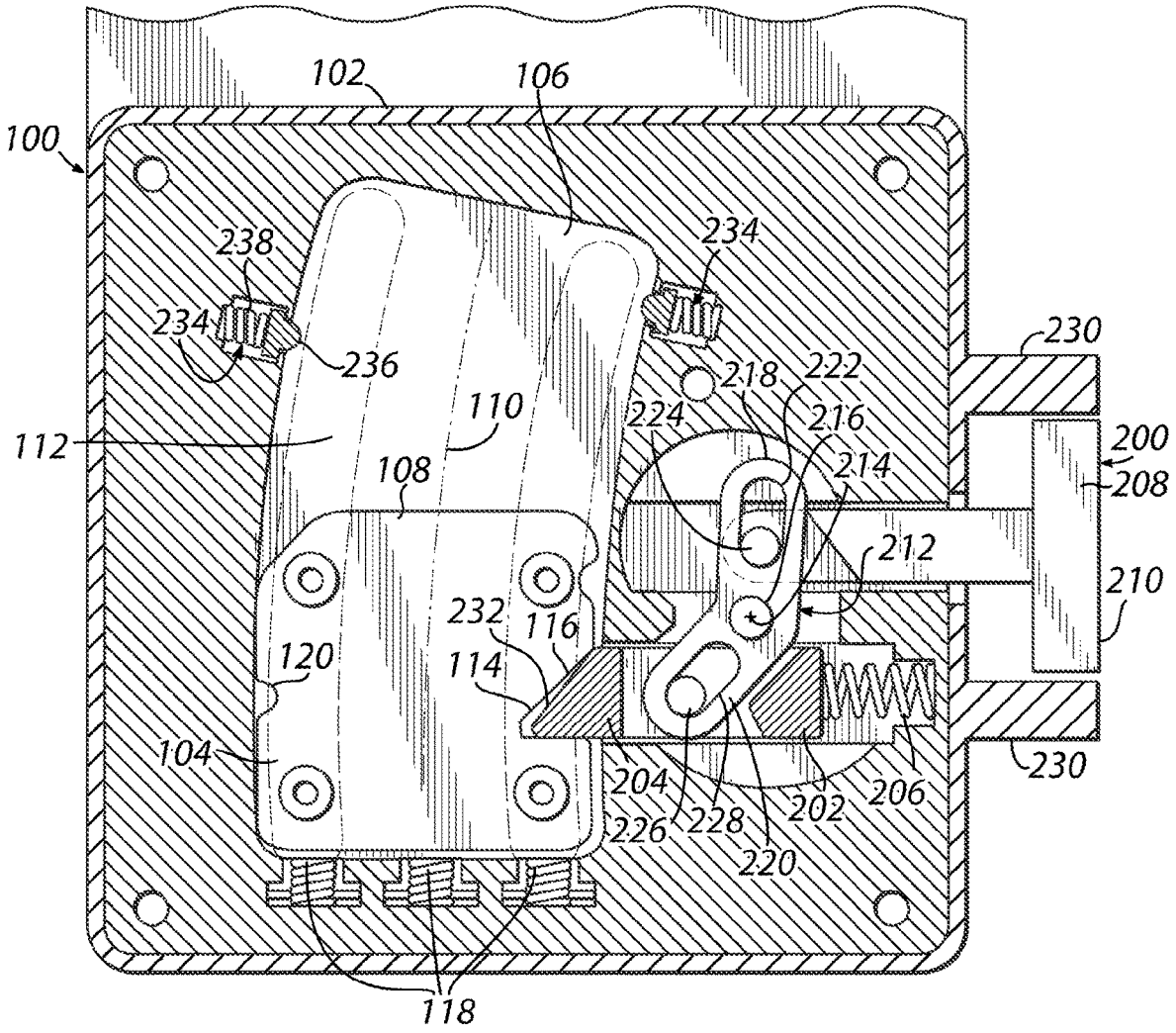
FIG. 4A is a cross-section view of the exemplary holster adapter of FIG. 1 in the first position.
Figure 4B:
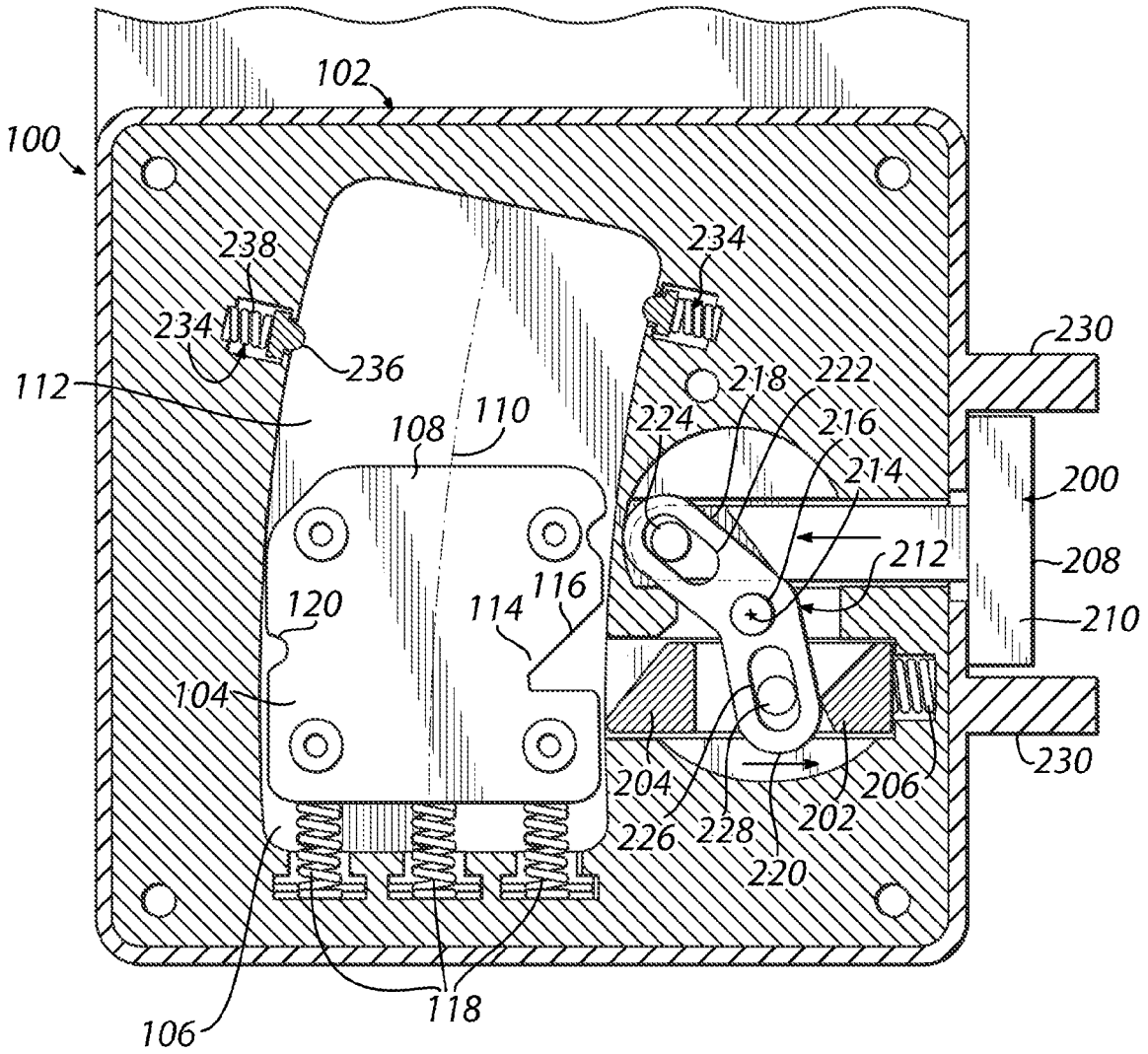
FIG. 4B is a cross-section view of the exemplary holster adapter of FIG. 1 in an intermediate position.
Figure 4C:
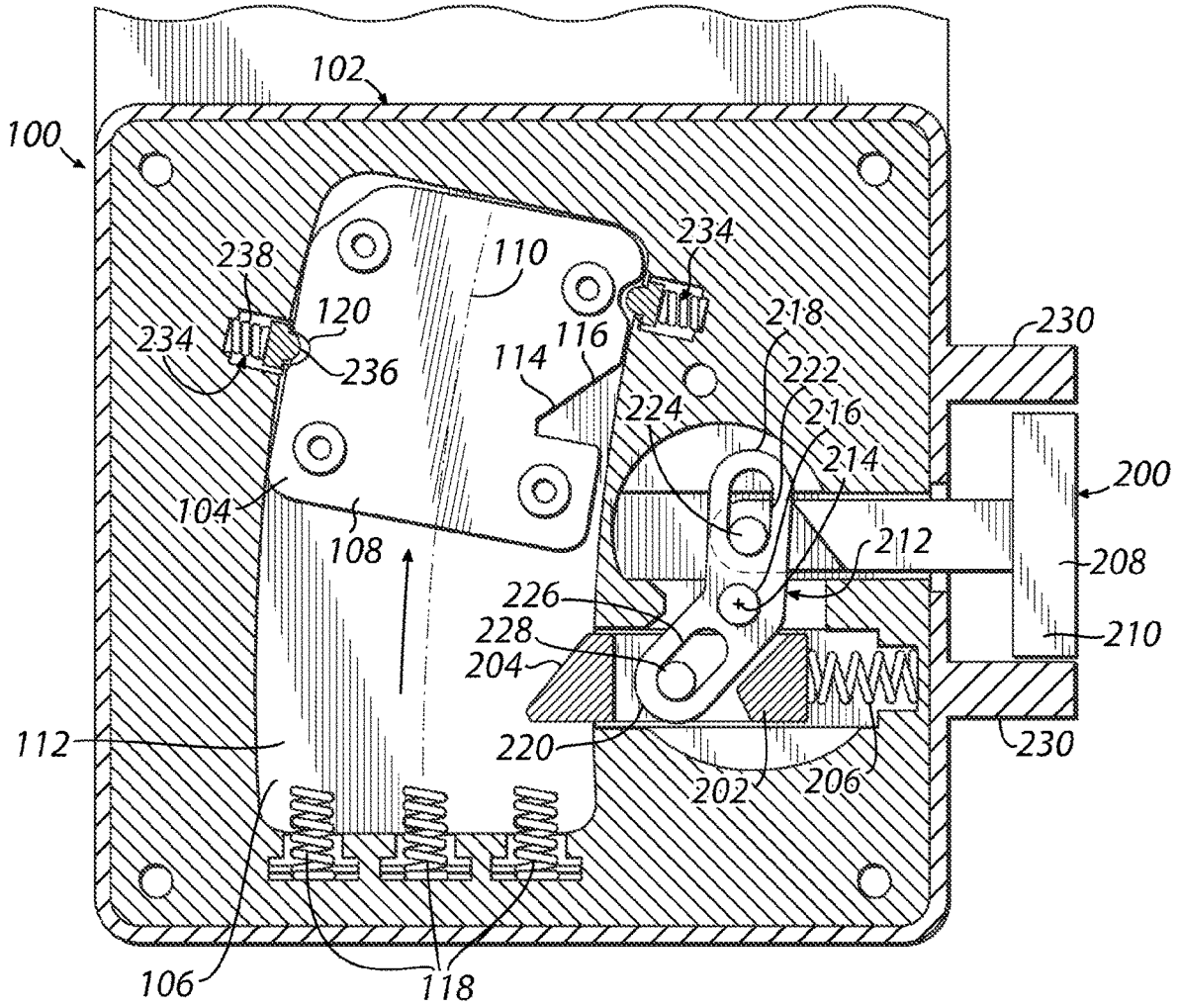
FIG. 4C is a cross-section view of the exemplary holster adapter of FIG. 1 in the second position.

FIG. 3A is an exploded perspective view of the exemplary holster adapter 100, FIG. 3B is an exploded perspective view of the exemplary holster system 10, FIG. 4A is a cross-section view of the exemplary holster adapter 100 in the first position, FIG. 4B is a cross-section view of the exemplary holster adapter 100 in an intermediate position, FIG. 4C is a cross-section view of the exemplary holster adapter 100 in the second position, all according to at least some aspects of the present disclosure.

Referring to FIGS. 3A-3B and 4A-4C, an exemplary holster adapter 100 may include an attachment component element 102, which may be configured to be secured with respect to the user 12 (FIG. 1) via the attachment component 18 (FIG. 1). In some exemplary embodiments, at least a portion of the attachment component element 102 may be configured to be secured to the attachment component 18, such as by one or more threaded fasteners. In some exemplary embodiments, at least a portion of the attachment component element 102 may be integrally formed with at least a portion of the attachment component 18. As used herein, "integrally formed" may refer to elements that are formed as a single component (e.g., machined from one blank and/or molded as a unitary piece) and/or permanently attached together (e.g., using welding, adhesive, or permanent fasteners) so that the elements are not readily non-destructively separable.

The exemplary holster adapter 100 may include a holster element 104, which may be configured to be secured with respect to the firearm holster 16. For example, the holster element 104 may be secured to the firearm holster 16 by one or more threaded fasteners, which may extend generally as indicated by arrows in the exploded view of FIG. 3B. In some exemplary embodiments, at least a portion of the holster element 104 may be integrally formed with at least a portion of the firearm holster 16.

In some exemplary embodiments, the attachment component element 102 and the holster element 104 may comprise a slidable track and traveler mechanism. For example, the attachment component element 102 may comprise a track 106 and/or the holster element 104 may comprise a traveler 108. The track 106 and/or the traveler 108 may be configured so that the traveler 108 is movable along a path 110 as the holster system 10 is moved between the first position and the second position. The path 110 may be at least partially defined by the track 106. The track 106 may comprise an elongated channel 112 configured to slidably receive the traveler 108 at least partially therein. The track 106 may be generally arcuate to at least partially define an arcuate path 110 for the traveler 108. In some exemplary embodiments, the arcuate path 110 may be arranged so that movement of the traveler 108 along the arcuate path 110 simultaneously changes both a relative orientation and a relative location of the holster element 104 relative to the attachment component element 102. For example, movement along the arcuate path 110 may change a relative orientation (e.g., angle), a relative ride height (e.g., generally vertical location), and/or a generally forward-rearward location of the holster element 104 relative to the attachment component element 102. In some exemplary embodiments, the attachment between the firearm holster 16 and the holster element 104 may be substantially rigid. For example, the firearm holster 16 may not be freely rotatable relative to the holster element 104. Further, the angle of the holster element 104 relative to the attachment component element 102 may determine the relative angle of the firearm holster 16 relative to the attachment component 18.

Referring again to FIGS. 3A-3B and 4A-4C, the exemplary holster adapter 100 may include a locking mechanism, such as a selectively actuated locking mechanism 200, which may be configured to selectively secure the holster system 10 in at least one position. For example, the locking mechanism 200 may be configured to releasably secure the traveler 108 relative to the track 106 in the first position, thereby securing the holster system 10 in the first (e.g., standing) position.

The locking mechanism 200 may include a mechanism locking element 202 arranged to selectively engage a traveler locking element 114. For example, the mechanism locking element 202 may comprise a movable latch bolt 204, which may be biased by a spring 206 from an unlocked position (FIG. 4B) towards a locked position (FIG. 4A). The traveler locking element 114 may comprise a notch 116 arranged to selectively engage the latch bolt 204 to secure the traveler 108 with respect to the track 106.

The latch bolt 204 may be moveable by a user-operated actuator 208. For example, a button 210 may be depressible by a user to retract the latch bolt 204. The actuator 208 may be operatively coupled to the latch bolt 204 by a pivotable crank 212. The crank 212 may be pivotable about an axis 214, which may be defined by one or more pins 216. The crank 212 may include a first arm 218 coupled to the actuator 208 and/or a second arm 220 coupled to the latch bolt 204. The first arm 218 may include a slot 222 configured to slidably and/or pivotably engage a pin 224 disposed on the actuator 208. Similarly, the second arm 220 may include a slot 226 configured to slidably and/or pivotably engage a pin 228 disposed on the latch bolt 204.

The latch bolt 204 may include an angled face 232. The angled face 232 may be oriented generally towards traveler 108 when the traveler 108 is in the second position, thus allowing the traveler 108 to push the latch bolt 204 aside as the traveler 108 moves from the second position to the first position.

The exemplary holster adapter 100 may include one or more springs 118, which may be arranged to bias the traveler 108 away from the first position. For example, the springs 118 may be disposed proximate the first-position portion of the track 106 so that the traveler 108 at least partially compresses the springs 118 as the traveler 108 reaches the first position. While the traveler 108 is held in the first position by the latch bolt 204, the springs 118 remain compressed. When the latch bolt 204 is retracted (e.g., by the user depressing button 210), the springs 118 may move the traveler 108 away from the first position and towards the second position. When moving from the second position to the first position, the user may overcome the force of springs 118 to place the traveler 108 into the first position.

The exemplary holster adapter 100 may include one or more retaining elements 234 configured to selectively retain the traveler 108 in the second position. An exemplary retaining element may comprise a tab 236 which may be biased towards the channel 112 by a spring 238. The tab 236 may be rounded and/or may be arranged to selectively engage a cutout 120 on the traveler 108. In some exemplary embodiments, the engagement of the tab 236 with the cutout 120 may be sufficient to hold the traveler 108 in the second position, such as sufficient to maintain the traveler 108 in the second position despite weight of the firearm 14 and firearm holster 16. In some exemplary embodiments, the retaining element(s) 234 may be releasable by application of external force on the firearm 14 and/or the firearm holster 16 in a direction generally from the second position toward the first position (e.g., by a user). Accordingly, the holster adapter 100 may be repositionable from the second position to the first position by a one-handed, gross-motor-skill movement of the firearm holster 16 along the arcuate path 110.

Some exemplary holster adapters 100 may include one or more housing elements, 122, 124, which may be configured to provide structural support for and/or to contain various other components. In the exemplary embodiment illustrated in FIG. 3A, the attachment component element 102 comprises housing elements 122, 124. Referring to FIGS. 3A and 3B, in some exemplary embodiments, the actuator 208 (e.g., button 210) may be positioned so that it may be actuated and the firearm holster 16 may be repositioned using one hand. For example, the actuator 208 may be positioned on a generally forward-facing portion of the housing 122, 124 when the holster system 10 is worn. The actuator 208 may be at least partially protected by one or more guards 230, which may reduce the risk of unintentional actuation of the actuator 208. In alternative exemplary embodiments, the actuator 208 may be positioned on other aspects of the housing 122, 124, such as on the top of the housing 122, 124.

Referring to FIGS. 3A and 3B, various components of the holster system 10 may be attached to one another using various fasteners, such as threaded fasteners (e.g., screws, nuts, and/or bolts). For example, in some exemplary embodiments, the holster 16 may be secured to the holster element 104 using a holster mounting plate 26. The holster mounting plate 26 may include one or more holster attachment elements, such as bosses or holes 28 configured to receive threaded fasteners for attachment to the holster 16. The present disclosure contemplates that different holsters 16, such as holsters 16 produced by different manufacturers, may be configured for use with different holster attachment elements. Accordingly, holster mounting plates 26 having specific holster attachment element configurations may be used with specific holsters 16. Alternatively, some exemplary holster mounting plates 26 may include holster attachment elements designed accommodate more than one holster 16, such as by including holes 28 configured for use with more than one holster 16. In some example embodiments, the holes 28 may be configured to allow assembly with the firearm holster 16 at different angles relative to the holster mounting plate 26. For example, multiple sets of holes 28 at different angles may be provided and/or one or more of the holes 28 may be in the form of an elongated slot. The firearm holster 16 may be coupled to the holster mounting plate 26 and may be secured at the desired relative angle. The holster mounting plate 26 may include one or more adapter attachment elements, such as holes 30 configured to receive threaded fasteners for attachment to one or more corresponding holes 32 of the holster element 104. Each hole 32 of the holster element 104 may be positioned in a boss 34, which may extend through a slot 36 in the housing element 122. The slot 36 may be shaped generally similar to the path 110 (FIG. 4A) to allow movement of the holster element 104 relative to the attachment component element 102 between the first and second positions. In some exemplary embodiments, the holster mounting plate 26 may be first secured to the holster 16. Then, the holster mounting plate 26 may be secured to the holster element 104 of the holster adapter 100. For example, with the holster element 104 in a predetermined position (e.g., the lower, first position), one or more access holes 240 through the housing 102 may be generally aligned with the holes 32 of the holster element 104. Accordingly, fasteners may be inserted through the access holes 240 to extend between and couple the holster element 104 to the holster mounting plate 26. Some alternative exemplary embodiments may be configured so that the firearm holster 16 may be directly coupled to the holster element 104 (e.g., without the use of a holster mounting plate 26) in a generally similar manner, such as by fasteners extending between and coupling the holster element 104 to the firearm holster 16. See, for example, FIG. and the corresponding description below.

An exemplary holster system 10 according to at least some aspects of the present disclosure may be operated as follows. Starting in the first position (e.g., FIG. 4A), the user 12 may depress the button 210 to retract the latch bolt 204 (e.g., overcoming the force of spring 206). With the latch bolt 204 retracted, the springs 118 may move the traveler 108 away from the first position and towards the second position (e.g., generally upward) as shown in FIG. 4B. The user 12 may move the traveler 108 along the path 110 to the second position as shown in FIG. 4C, such as by pulling upwards on the firearm 14 and/or the firearm holster 16. The spring 206 may return the latch bolt 204 to the extended position and/or the button 210 to the undepressed position. As the traveler 108 approaches the second position, the traveler 108 may contact the retaining elements 234, pressing them outward by overcoming the force of the springs 238. When the traveler 108 reaches the second position, the cutouts 120 of the traveler 108 align with the tabs 236 of the retaining elements 234, and the tabs 234 extend into the cutouts 120, thereby retaining the traveler 108 in the second position. Generally, repositioning from the first position to the second position may be performed with one hand.

Starting in the second position (e.g., FIG. 4C), the user 12 may apply an external force to the firearm 14 and/or the firearm holster 16 in a direction generally from the second position to the first position. This force may overcome the retention of the traveler 108 in the second position by the retaining elements 234. As shown in FIG. 4B, as the traveler 108 approaches the first position, the traveler 108 may contact the springs 118. The user 12 may press the firearm 14 and/or the firearm holster 16 toward the first position, overcoming the force of the springs 118 and at least partially compressing the springs 118. Also, as the traveler 108 approaches the first position, the traveler 108 contacts the angled face 232 of the latch bolt 204, causing the latch bolt 204 to move aside. When the traveler 108 reaches the first position (e.g., FIG. 4A), the latch bolt 204 is aligned with the notch 116 and the spring 206 may cause the latch bolt 204 to engage the notch 116, thereby automatically engaging and securing the traveler 108 in the first position. Generally, repositioning from the second position to the first position may require only gross motor skills and/or may be performed with one hand.

An exemplary method of assembling a holster system 10 according to at least some aspects of the present disclosure may include assembling a holster adapter 100 by operatively connecting an attachment component element 102, a holster element 104, and a locking mechanism 200. The method may include installing various other components of the holster adapter 100 described herein. The method may include integrally forming at least a portion of the attachment component element 102 and at least a portion of the attachment component 18 and/or coupling the attachment component element 102 and the attachment component 18. The method may include attaching the attachment component 18 to a duty belt or webbing attachment system (e.g., MOLLE) and/or securing the holster element 104 to the firearm holster 16.

Figure 5:
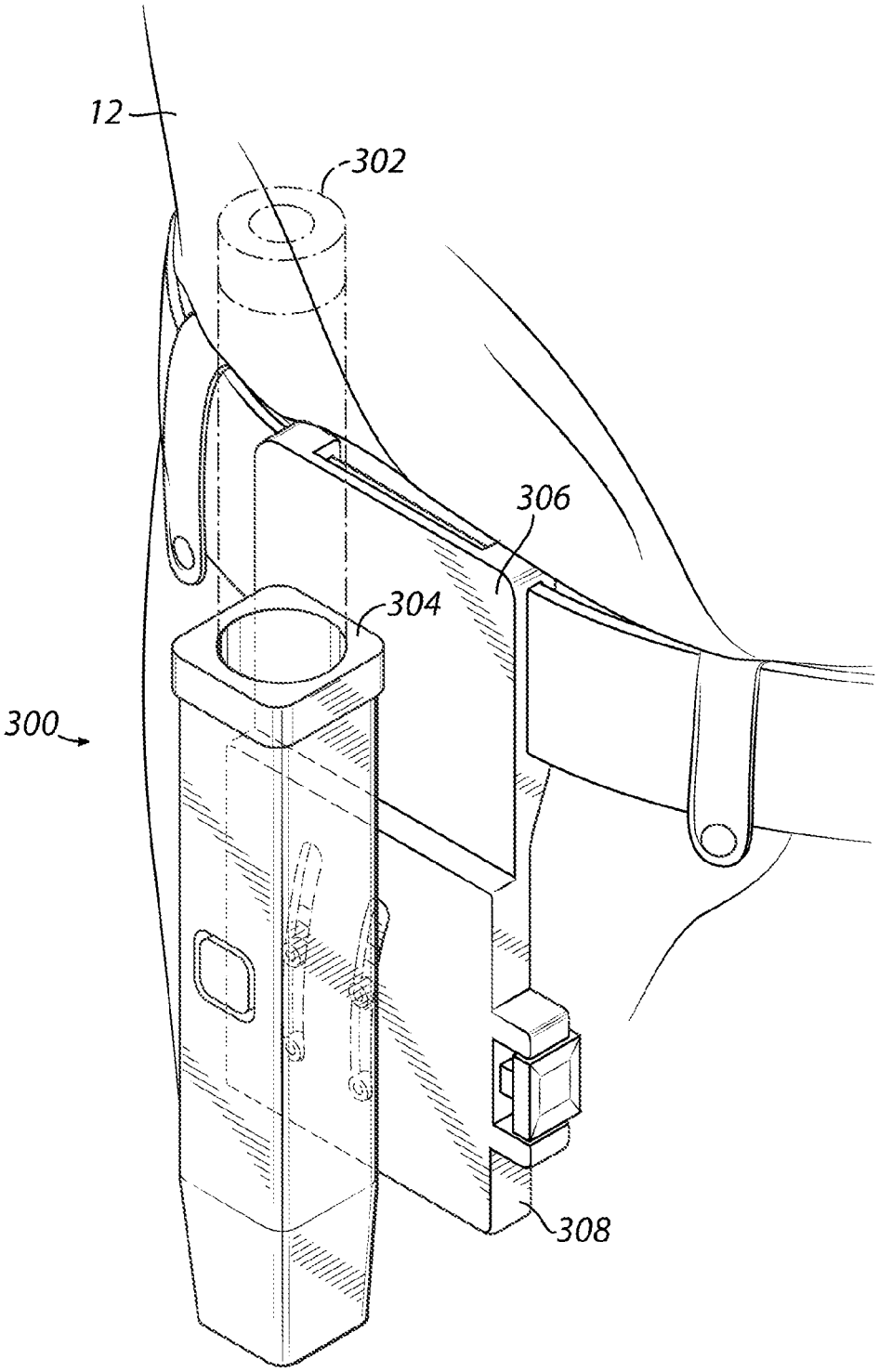
FIG. 5 is a perspective view of an alternative exemplary holster system for a baton.

FIG. 5 is a perspective view of an alternative exemplary holster system 300 for a baton 302, according to at least some aspects of the present disclosure. The holster system 300 may include a baton holster 304, which may be configured to hold the baton 302. The holster system 300 may include an attachment component 306, which may be configured to be secured to the user 12. The holster system 300 may include a holster adapter 308, which may operatively couple the baton holster 304 and the attachment component 306. The holster adapter 308 may be configured to allow the user to reposition the baton holster 304 relative to the attachment component 306. Generally, this exemplary holster system 300 may be constructed and operated similar to the holster system 10 described above, and repeated description is omitted for brevity. In this exemplary embodiment, the baton holster 304 is coupled directly to the holster adapter 308 without a component corresponding to holster mounting plate 26 discussed above with respect to holster system 10.

The description above and the drawings referenced therein have focused on exemplary embodiments associated with holsters for firearms and batons. Alternative exemplary embodiments may be associated with other law enforcement or military carrying apparatus for other objects, such as knives, nightsticks, flashlights, ammunition cartridges, or other devices. Further, other alternative embodiments may be associated with carrying objects for civilian use (e.g., not law enforcement, not military). Generally, any aspect or feature of any exemplary embodiment described herein may be utilized in connection with any other embodiment.

Although the description and drawings have focused on exemplary embodiments configured for use on a user's right hip, various alternative exemplary embodiments may be configured for use in other locations on a user's body, such as on the left hip, at any other location around or near the waist, under or adjacent to either armpit, on either leg, on either ankle or calf, on the chest, or on other locations on a user's body.

The description and drawings have focused on exemplary embodiments in which the firearm holster 16 or the baton holster 304 comprises a single piece or assembly that is intended to remain attached to the holster adapter 100, 308. Alternative exemplary embodiments may comprise holsters having quick attachment/detachment features. For example, an alternative firearm holster may include an attachment system comprising a locking fork and a locking receiver. The locking receiver may be secured to the holster adapter and/or the locking fork may be secured to the portion of the holster holding the firearm. The locking fork may be selectively attached to and detached from the locking receiver, thereby allowing the user to mount and unmount the portion of the holster holding the firearm. A user may utilize such as system to quickly switch holsters or firearms on a duty belt or to move a holster or firearm to a different duty belt, for example.

While the present disclosure includes a description of various exemplary embodiments, and while these exemplary embodiments have been described in considerable detail, it is not intended to restrict or in any way limit the scope of the appended claims to such detail. The various features shown and described herein may be used alone or in any combination. Additional advantages and modifications will readily appear to those skilled in the art. The disclosure in its broader aspects is therefore not limited to the specific details, representative apparatus and methods, and illustrative examples shown and described. Accordingly, departures may be made from such details without departing from the spirit and scope of the general inventive concept.

What is claimed is:

1. A holster system, comprising:

an attachment component configured to be secured on a user;

a firearm holster configured to hold a firearm; and a holster adapter operatively coupling the firearm holster and the attachment component, the holster adapter being configured for one-handed repositioning of the firearm holster relative to the attachment component along an arcuate path between a first position and a second position while the holster system is worn by the user;

wherein the first position comprises a first location and a first orientation, and the second position comprises a second location, different from the first location, and a second orientation, different from the first orientation.

2. The holster system of claim 1, wherein the first position is associated with a standing position of the user and the second position is associated with a sitting position of the user.

3. The holster system of claim 2, wherein the holster adapter is configured so that the firearm holster is disposed relative to an upper body of the user in substantially the same orientation in both of the first position and the second position.

4. The holster system of claim 1, wherein the holster adapter is configured so that movement of the firearm holster relative to the attachment component along the arcuate path simultaneously changes both a relative orientation and a relative location of the firearm holster with respect to the attachment component.

5. The holster system of claim 1, wherein the holster adapter is repositionable from the second position to the first position by a one-handed, gross-motor-skill movement of the firearm holster along the arcuate path.

6. The holster system of claim 1, wherein the holster adapter comprises a selectively actuated locking mechanism configured to selectively secure the holster adapter in the first position.

7. The holster system of claim 6, wherein the holster adapter is repositionable from the first position to the second position by one-handed disengagement of the locking mechanism and movement the firearm holster along the arcuate path.

8. The holster system of claim 1, wherein the holster adapter comprises a retaining element configured to releasably retain the holster adapter in the second position.

9. The holster system of claim 8, wherein the retaining element is releasable by application of force on the firearm holster in a direction generally from the second position toward the first position.

10. A holster adapter configured to operatively couple a firearm holster and an attachment component, the firearm holster being configured to hold a firearm and the attachment component being configured to be secured on a user's body, the holster adapter comprising:

an attachment component element configured to be secured relative to the user via the attachment component;

a holster element configured to be secured to the firearm holster; and a locking mechanism configured to selectively secure the holster element with respect to the attachment component element in a first position comprising a first location and a first orientation;

wherein one of the attachment component element or the holster element comprises a traveler, the other of the attachment component element or the holster element comprises a track;

wherein the track defines an arcuate path along which the traveler is selectively movable while the firearm holster is worn by the user the first position and a second position comprising a second location, different from the first location, and a second orientation, different from the first orientation.

11. The holster adapter of claim 10, wherein the traveler and the track are configured so that movement of the traveler relative to the track along the arcuate path simultaneously changes both a relative orientation and a relative location of the holster element with respect to the attachment component element.

12. The holster adapter of claim 10, wherein the attachment component element comprises the traveler and the holster element comprises the track.

13. The holster adapter of claim 10, wherein the locking mechanism comprises a spring-biased latch bolt configured to selectively engage the traveler to secure the traveler with respect to the track when the traveler is in the first position.

14. The holster adapter of claim 10, further comprising a retaining element configured to selectively retain the traveler in the second position.

15. The holster adapter of claim 14, wherein the retaining element comprises a spring-biased tab extending from the track to releasably engage the traveler when the traveler is in the second position.

16. The holster adapter of claim 14, wherein the retaining element is releasable by application of force on the traveler in a direction generally from the second position toward the first position.

17. A method of assembling a holster system, the method comprising:

assembling a holster adapter by operatively connecting (i) an attachment component element configured to be secured to an attachment component, (ii) a holster element configured to be secured to a firearm holster, and (iii) a locking mechanism, so that the holster element is repositionably coupled to the attachment component element for movement along an arcuate path relative to the attachment component between a first position and a second position, the locking mechanism being configured to selectively secure the holster element with respect to the attachment component element in the first position;

wherein the first position comprises a first location and a first orientation, and the second position comprises a second location, different from the first location, and a second orientation, different from the first orientation; and wherein movement along the arcuate path simultaneously changes both a relative orientation and a relative location of the holster element relative to the attachment component element while the holster system is worn by a user.

18. The method of claim 17, wherein assembling the holster adapter comprises operatively connecting a traveler and a track, the holster element comprising the traveler, the attachment component element comprising the track, the track defining the arcuate path, the traveler being selectively movable along the arcuate path between the first position and the second position.

19. The method of claim 17, wherein assembling the holster adapter comprises installing a latch bolt arranged to selectively secure the holster element relative to the attachment component element when the holster element is in the first position.

20. The method of claim 17, further comprising installing a retaining element configured to selectively retain the holster element in the second position.

* * * * *